United States Patent [19]

Bedics

[11] Patent Number: 5,054,253

[45] Date of Patent: Oct. 8, 1991

[54] RIGID GRATING MAT WITH UNIDIRECTIONAL ELEMENTS

[75] Inventor: Michael A. Bedics, Poughquag, N.Y.

[73] Assignee: Pawling Corporation, Pawling, N.Y.

[21] Appl. No.: 452,205

[22] Filed: Dec. 18, 1989

[51] Int. Cl.[5] ..... E04C 1/30

[52] U.S. Cl. ..... 52/177; 52/181; 403/35; 15/215

[58] Field of Search ..... 52/177, 179, 180, 181; 404/35; 15/215, 217, 238; 428/53

[56] References Cited

U.S. PATENT DOCUMENTS

| | | | |
|---|---|---|---|
| 3,150,748 | 9/1964 | Liskey | 52/126.6 |
| 3,783,471 | 1/1974 | McGreary et al. | 52/181 |
| 4,126,006 | 11/1978 | Lewis | 52/177 |
| 4,804,570 | 2/1989 | Bedics | 15/217 |
| 4,879,151 | 11/1989 | Ellingson | 52/181 |

FOREIGN PATENT DOCUMENTS

| | | | |
|---|---|---|---|
| 956784 | 4/1964 | United Kingdom | 52/588 |

*Primary Examiner*—James L. Ridgill, Jr.

*Attorney, Agent, or Firm*—Schweitzer Cornman & Gross

[57] ABSTRACT

A grating mat assembly is disclosed, which is of a generally rigid construction, as distinguished from an articulated, roll-up construction. Unlike conventional rigid grating mats, the structure of the present invention comprises a plurality of slot-like section joined edge to edge in a manner providing for sufficiently rigidity for manufacture, handling and installation, while eliminating the customary longitudinally extending locking bars, utilized in more conventional grating mat assemblies, which add significantly to the cost of manufacture thereof. The slot-like mat sections of the new design are of extruded construction, formed with a horizontal upper ball, widely spaced vertical end walls, and one or more intermediate vertical walls. The vertical walls support the upper wall substantially above a base surface. The opposite vertical end walls of the slot-like sections are formed with tongue and groove structures, such that a pair of adjacent section interfit to provide positive horizontal alignment. Adjacent slot-like sections are secured tightly together either by way of the tongue and groove structure, or by separate means.

10 Claims, 1 Drawing Sheet

2
2
11
13
10

39
24
24

10
13
34
37
39
38
32
32
17
31
18
30
20
21
23
4
4
11
26
25
16
14
12
29
21
15
24
29
19
15
17
31
23
36
33
35

60
59
58

51
57
55
55
56
54
50
52
53

15
30
31
32
21

RIGID GRATING MAT WITH UNIDIRECTIONAL ELEMENTS

BACKGROUND AND SUMMARY OF THE INVENTION

The invention is directed generally to the field of rigid grating mats, such as are commonly utilized in the entrances to buildings and the like. Typically, such grating mats are comprised of an assembly of rigid structural elements provided with tread strips to define the upper surface, and usually are provided with openings between tread strips to allow for the passage of water and dirt. Customarily, the grating mats are recessed in the floor surface, so as to form a substantial continuation of that surface. The recess in which the grating is supported may include a drain for removal of excess water.

Heretofore it has been quite customary to construct grating mats of structural elements extending both transversely and longitudinally. The principal grating structure is formed of a plurality of tread-supporting members, arranged in sideby-side relation, usually spaced somewhat from each other. These elements, which normally extend transversely, are rigidly joined by a plurality of longitudinally extending locking bars, which secure the assembly of tread supports in the desired spaced relation and with a desired degree of rigidity. Representative examples of such earlier grating mats are reflected in the Viehmann et al. U.S. Pat. No. 3,383,822 and the Reifsnyder U.S. Pat. No. 4,112,640. Among the disadvantages of the known constructions of grating mats is the comparative difficulty (and therefore the increased cost) of assembly. Because of the necessity of first aligning and spacing structural elements of a first type (tread supports) in order to receive connecting elements arranged at rights angles thereto, it is usually necessary to provide an elaborate assembly jig into which the tread supports are carefully placed, to enable the oppositely disposed connecting elements to be inserted. Typically, the connecting elements are provided with slots, aligned with each of the tread supports, so that the connecting elements, when inserted into position, can be rotated to a different position to lock all of the tread supports in fixed relation. In order to provide an effective assembly, a considerable degree of precision in manufacture and care in assembly is required.

In accordance with the present invention, a grating mat is provided in which all of the structural elements extend in one direction, for example transversely, and an adequate degree of rigidity in the longitudinal direction is provided by the cross sectional configuration of the individual, transversely disposed tread supports.

In one advantageous form of the invention, the grating mat is constructed of a plurality of transversely disposed slat-like tread supports of a generally uniform cross sectional configuration, shaped to provide an element of substantial height in relation to wall thickness of the material and of substantial width in relation to height. Each transversely disposed tread support is lockinqly joined with its neighbor by a tongue and groove structure, enabling one tread support to be engaged with its neighbor by a longitudinal sliding assembly. It is not intended that the tongue and groove connection between adjacent tread supports have any significant degree of hinging action. Indeed, the more tightly and rigidly the two adjacent pieces are joined, the better, there being practical limits, of course, in terms of reasonable manufacturing tolerances and reasonable fits to enable facile assembly of the parts.

In another advantageous embodiment of the invention, the tongue and groove structures of adjacent slats are of a flat or other configuration accommodating lateral assembly of adjacent slats, with the tongue and groove structure serving to align the adjacent elements vertically. After assembly, the opposite end extremities of the assembled tongue and groove structures are crimped by means of a suitable crushing tool, which serves to mechanically lock the elements in their assembled relation. Alternatively, or in addition, high strength adhesive strips may be interposed between laterally adjacent slats, in order to secure them in assembled relation.

To advantage, each of the tread supports is of sufficient width to accommodate a plurality of individual tread strips. These are desirably arranged so that a tread strip spans over each juncture between adjacent, connected tread supports. The area of joining is not visible.

At the end extremities of the grating mat assembly, there are provided especially configured end supports of narrower section, so that the eventual overall length of the grating mat structure can be adjusted by increments of one tread width in order to be fit into recess frames of various standard sizes.

For a better understanding of the above and other features and advantage of the invention, reference should be made to the following detailed description of a preferred embodiment and to the accompanying drawing.

DESCRIPTION OF PREFERRED EMBODIMENTS OF THE INVENTION

Figure 1:
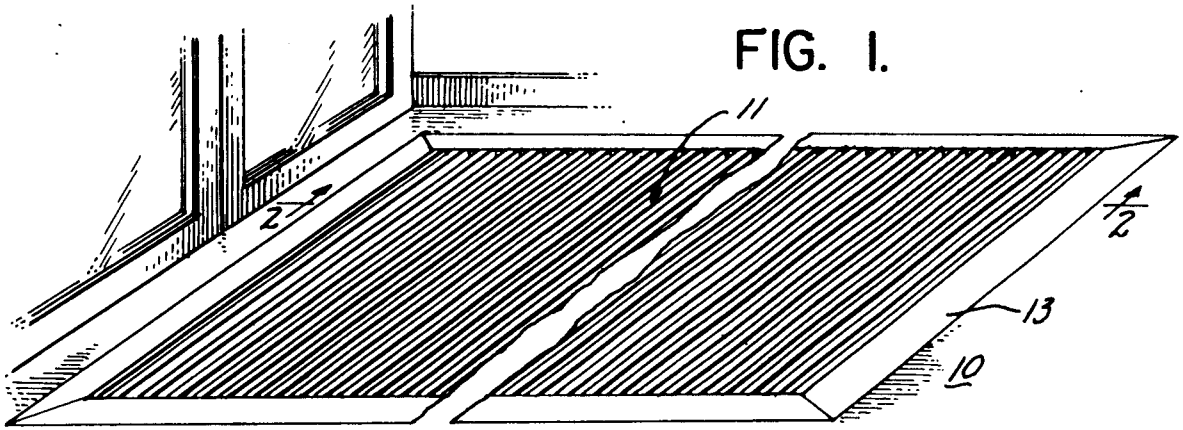
FIG. 1 is a perspective view of the entrance area to a typical office or building, illustrating a grating mat of the type constructed in accordance with the invention.
Figure 3:
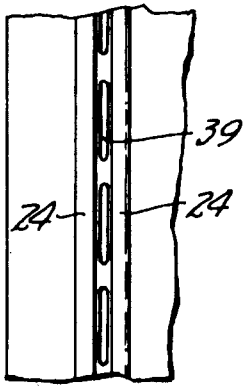
FIG. 3 is a top plan view of a fragmentary section of tread support incorporated in the grating mat of FIGS. 1 and 2.

Referring now to the drawing, and initially 1–4, thereof, the reference numeral 10 designates generally the entrance floor of an office, public building or the like. An entrance mat, generally designated by the reference numeral 11, is received in a correspondingly configured recess 12 in the entrance floor. Typically, although not necessarily, the recess 12 is defined by a border frame 13, which is predimensioned to the mat 11 and set in the floor 10 at the time the flooring material is poured.

The mats 11 are extensively varied in size, depending upon the particular application. Usually, although not critically, the grating mat is of a rectangular overall configuration.

In accordance with one aspect of the invention, the grating mat 11 is made up of a series of transversely extending slat-like tread support sections 14. These are substantially elongated in relation to width. For example, in one advantageous embodiment, the width of the tread supports may be approximately 5.5 inches, whereas the length of the tread support (defining the width of the mat structure) may be several feet.

In the illustrated form of the invention, the tread supports 14 are designed to support a plurality of individual tread strips 15, which are in themselves well known and standardized elements widely used in the manufacture of entrance mat structures. As reflected in FIG. 2, the tread support has an overall width corresponding to the width of three properly spaced tread strips 15.

Pursuant to the invention, the tread support sections 14 are of substantial height, although the height thereof is a fraction of the width. In an advantageous embodiment, the height of the tread supports is approximately 1.375 inches as compared to a width of approximately 5.5 inches, providing a width to height ratio of approximately 4. To advantage, the tread support sections 14 are of a uniform, extruded cross section, of a suitable structural material, such as aluminum. The height of the element is a substantial multiple of the wall thickness of the material in order to provide a lightweight structure to facilitate handling. For example, whereas the height of the element is approximately 1.375 inches, the typical wall thickness is approximately 0.080 inch. Desirably, the tread support strips 14 are of a relatively sharply rectangular cross sectional outline, comprising a generally flat upper wall 16 joined at each lateral edge extremity by vertically downwardly extending lateral walls 17, 18. To provide adequate support of the upper wall 16, one or more intermediate support walls 19, 20 are provided. These extend vertically downward from the upper wall 16, approximately uniformly spaced from each other and from the respective lateral walls 17, 18.

At the bottom of each of the intermediate walls 19, 20 are foot flanges 21 which extend horizontally in opposite directions from the intermediate walls in the form of an inverted "T". The lateral walls 17, 18 are likewise provided with horizontal foot flanges 22, 23 although in the latter case the flanges extend only in one direction, inwardly, to impart a somewhat L-shaped cross section to the lateral wall 17, 18.

Extending along the length of the tread support sections 14 (transversely of the mat structure itself) are adjacent pairs of retaining flanges 24, 25, 26 of inverted L-shaped configuration. Spaced-apart pairs of such flanges (24–25 and 25–26) cooperate to mount and retain the tread strips 15. These may be installed either by sliding them longitudinally along the opposed channels 29 or, depending upon the specific nature of the tread strip material, by bowing the tread strip material cross-sectionally sufficiently to permit its lower flanges to be received in the strip-retaining channels. In the illustrated arrangement, the tread strips 15 are formed of a resilient extruded strip material. However, it is also possible (and common) to utilize strips of pile carpet material, in which the backing layer of the carpet is engaged by the respective pairs of channels 24–25 or 25–26, etc.

In the illustrated arrangement, the intermediate tread strips being supported by each tread support 14 are located centrally over the intermediate vertical walls 19, 20. Along each lateral edge of the tread support there is room for only one half of the tread strip, with the opposite half being supported by the next adjacent tread support member.

Figure 2:
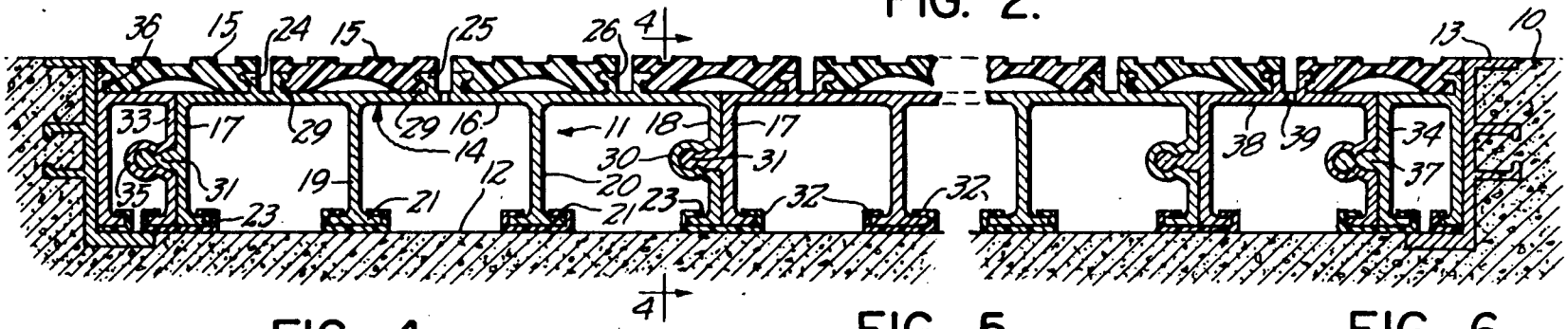
FIG. 2 is an enlarged, fragmentary cross sectional view as taken generally on line 2—2 of FIG. 1.

In the form of the invention illustrated in FIGS. 1–4, the outer lateral wall 18 of the tread support is provided with a longitudinally extending groove structure 30. The opposite lateral wall 17 is provided with a correspondingly configured and located, longitudinally extending tongue strip 31, arranged to be received closely within the groove 30 of an adjacent tread support. In the illustrated arrangement, the cross sectional configuration of the groove 30 is more or less of a keyhole shape, as is the configuration of the tongue strip 31. This shape is not critical. However, in this illustrated embodiment, the configuration of the tongue and groove section is such as to require lengthwise sliding assembly of the tongue strip into the groove section and to prohibit direct lateral separation of a pair of adjacent tread supports 14, joined as indicated in FIG. 2.

To advantage, the tongue and groove connecting strips 30, 31 of an adjacent pair of tread supports are located approximately midway between the upper and lower extremities of the vertical lateral walls 17, 18. In a typical arrangement according to the invention, the tongue strip may have a thickness on the order of 0.174 inch, leaving a margin of directly confronting flat surface portions of the walls 17, 18, above and below the tongue strip, of about 0.60 inch. This rigidly joined relationship between adjacent tread supports, in conjunction with the substantial vertical expanse of confronting wall surfaces provides for an ample degree of rigidity of the structure, in the absence of separate structural elements extending at right angles to the tread supports 14, to enable the mat structure to be handled as necessary for assembly, shipping, installation, maintenance, etc. When the grating mat is installed and in use, of course, the entire mat structure is supported rigidly by the bottom surface of the recess 12, which supports the respective foot flanges 21.

Typically, although not necessarily, the foot flanges 21, 23 will be provided at spaced points with clip-like resilient flange guards 32. Principally, this reduces noise that otherwise might be created by direct contact by the aluminum foot flanges 21, 23 and the bottom surface of the recess 12, which typically is composed of concrete, terrazzo or the like.

In the assembly of a complete grating mat structure, the tread support elements 14 are assembled side-by-side, as many in number as is necessary to achieve the desired overall mat configuration. At each extremity, a half-width edge support 33 or 34 is provided (left and right edges, as viewed in FIG. 2). Inasmuch as each of the principal tread support sections 14 supports only a half tread at each edge, the final end support section 33 or 34 provides support for the remaining half. In the illustrated arrangement, for example, the edge support 33 is of "female" construction and is formed with a continuously extending groove 35 engageable with the tongue strip 31 of the principal support 14. The edge support is provided with a single flange 36 which, like the flanges 24, is of an inverted L-shaped configuration to engage and retain one edge of a tread strip 15. The opposite end edge strip 34 is of similar construction, but is of "male" configuration, being provided with a tongue strip 37 for engagement with a groove section of the adjacent tread support.

Inasmuch as the dimensions of the recess 12 may not always agree with the 5.5 inch width increments of the principal tread supports 14, the invention contemplates the provision of single-width and double-width tread support sections, of which a single-width tread support section 38 is shown at the right-hand side in FIG. 2. The general construction of the single-width support section 38 is largely the same as that of the support sections 14, except that the intermediate vertical walls 19, 20 of the latter are neither needed nor provided. For a double-width section (not shown) a single, central support wall would be provided, midway between the outside walls. In either case, the outside walls would be provided respectively with a continuously extending groove section, on one wall, and a continuously extending tongue section on the opposite wall.

After assembly of the tread supports, and end alignment of all the sections, the sections may be suitably locked in their assembled relation. A simple way to accomplish this is to squeeze down on the ends of the groove sections 30 with a high-advantage squeezing tool capable of at least slightly deforming the configuration of the groove strip.

To advantage, the space between back-to-back pairs of strip-retaining flanges (24–26), is provided with a series of elongated openings 39, through which water and small debris may pass. Where substantial water may be encountered, it may be appropriate to provide for a drainage basin in the recess 12. The need for such and the techniques for accomplishment are well known in the trade.

Figure 5:
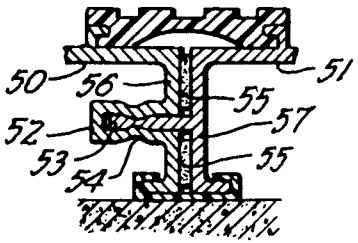
FIG. 5 is a fragmentary cross sectional view showing a modified form of the invention, with a modified form of connecting arrangement between adjacent tread supports.
Figure 4:
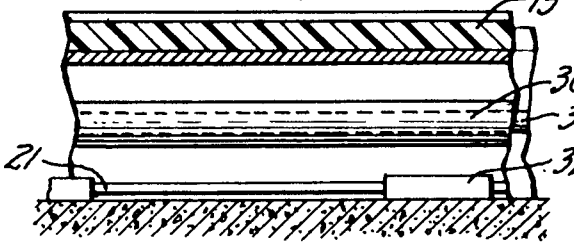
FIG. 4 is a fragmentary cross sectional view as taken generally on line 4—4 of FIG. 2.

In a modified form of the invention shown in FIG. 5, the tongue and groove connection between adjacent tread supports 50, 51 is formed without a key-hole shaped or other laterally interlocking relationship between the groove section 52 and the tongue strip 53. The tongue and groove in this case closely interfit in the vertical direction, so as to force accurate vertical alignment of adjacent tread supports. Securement of adjacent tread supports against lateral separation is provided by mechanical crimping of the laterally joined tongue and groove sections, as indicated at 54 in FIG. 5. Such mechanical crimping can be performed at the opposite end edges of the tread supports, by a suitable tool capable of applying crushing force to the assembled parts, sufficient to achieve deformation of the metal. This crimping serves two purposes: One, to prevent lateral separation of the assembled, adjacent tread supports, and two, to fix the adjacent tread supports relative to each other in the longitudinal direction.

The above described arrangement, shown in FIG. 5, is advantageous from a manufacturing standpoint, in that it accommodates assembly of adjacent tread supports without longitudinal sliding-together of the parts, so that the assembly operation is expedited considerably.

As an alternative to, or perhaps in conjunction with the provision of the mechanical crimping 54, adjacent tread supports may be joined together by means of strips of structural bonding tape, located above and below the tongue 53. The bonding tape is in itself well known and conventional, and is provided with contact adhesive of great strength on both surfaces. Accordingly, as the adjacent tread supports 50, 51 are assembled by sliding the tongue strip 53 side-wise into the groove section 52, the opposite end extremities of the respective tread supports are first carefully aligned, and then the vertical lateral walls 56, 57 are pressed strongly toward each other, to provide a high strength adhesive bond via the strips of bonding tape 55.

Figure 6:
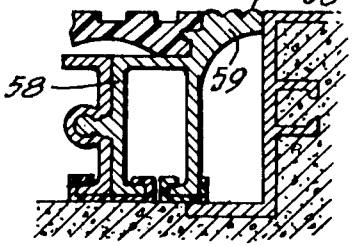
FIG. 6 is a fragmentary cross sectional view of a modified form of special end tread support section, provided with a variable width decorative flange to accommodate fine adjustment of mat length to fit a given recessed frame.

In the embodiment of FIG. 6, a modified form of halfwidth edge support 58 is provided, which is provided with an integral flange 59, at the level of the tread strips 15, formed with a plurality of rib-like elements 60 extending lengthwise of the element 58. The individual rib-like elements may easily be broken or severed from the flange to accommodate fine adjustment of the dimensions of the assembled mat.

The grating mat constructed in accordance with the invention provides for significantly advantageous manufacturing economies relative to conventional grating mats, since the ing tread support elements, eliminating entirely the need for painstaking alignment and installation of oppositely extending locking bars and the like. The construction of the invention also takes advantage of the ability to configure the tread support strips in a manner to support a plurality of tread strips (three in the illustration). This, in addition to the other manufacturing advantages, minimizes the number of parts that have to be handled and assembled.

The configuration of the tread support strips, providing directly confronting vertical walls of significant height, imparts sufficient handling rigidity to the grating mat structure, to accommodate all the necessary handling during manufacture, shipping and installation. Indeed, assembly is so simple that it would be realistic, where desired, to ship the grating mat in disassembled or partly assembled condition to the installation site, with assembly to be carried out or completed (as the case may be) at the installation site. The construction of the invention also has a favorable weight-toarea ratio as compared to conventional structures.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A rigid grating mat assembly, which comprises (a) a plurality of elongated, transversely extending slat-like tread support elements of uniform cross section and of substantially self-rigidifying construction, (b) each said tread support element comprising a horizontal upper wall, spaced vertical lateral walls at each lateral edge extremity, and one or more intermediate vertical walls, (c) said vertical walls supporting said upper wall substantially rigidly above a base surface, (d) the opposite vertical walls of a pair of adjacent tread support elements being in substantially face to face relation and having interfitting tongue and groove structures providing positive horizontal alignment of the upper walls of said adjacent elements, and (e) means for tightly securing adjacent lateral walls of adjacent relation, providing a substantially rigid structural relation between adjacent tread support elements in the absence of longitudinally extending bracing structure interconnecting said transversely extending sections.

2. Apparatus according to claim 1, further characterized by (a) said interfitting tongue and groove structures being of interlocking configuration, whereby to prevent lateral separation of adjacent tread support elements.

3. Apparatus according to claim 1, further characterized by (a) said means for tightly securing adjacent tread support elements comprising mechanically crimped and deformed portions of said tongue and groove structures.

4. Apparatus according to claim 1, further characterized by (a) said means for tightly securing adjacent tread support elements comprising adhesive means joining confronting lateral wall surfaces of adjacent tread support sections, above and below said tongue and groove structures.

5. Apparatus according to claim 1, further characterized by (a) a plurality of tread strips arranged in side-by side relation on said tread support elements, (b) said tread support elements having a width sufficient to support a plurality of tread strips, (c) channel forming means on the upper wall of said tread support elements for engaging and positioning said tread strips, (d) said channel forming means being so located as to position tread strips to be only partially supported along each lateral edge of said tread supports, whereby tread strips span over the joints between adjacent tread supporting elements.

6. Apparatus according to claim 5, further characterized by (a) said assembly including edge support elements at each end thereof, (b) said edge support elements having a width less than the width of a tread strip and serving to support a portion of the tread strip overlapping with an edge portion of the adjacent tread support element.

7. A rigid grating mat assembly, which comprises (a) a plurality of elongated, transversely extending slat-like tread support elements of uniform cross section and of substantially self-rigidifying construction, (b) each said tread support element comprising a horizontal upper wall, spaced vertical lateral walls at opposite lateral edge extremities, and one or more intermediate vertical walls, (c) said vertical walls supporting said upper wall substantially rigidly above a base surface, (d) said vertical walls having a height which is a substantial multiple of their wall thickness, (e) said tread support elements having a width substantially greater than their height, (f) the opposite vertical walls of a pair of adjacent tread support elements being in substantially face to face relation and having interfitting tongue and grove structures providing positive horizontal alignment of the upper walls of said adjacent elements, and (g) means for tightly securing adjacent lateral walls of adjacent tread support elements in laterally adjacent relation, providing a substantially rigid structural relation between adjacent tread support elements in the absence of longitudinally extending bracing structure interconnecting said transversely extending sections.

8. Apparatus according to claim 7, further characterized by (a) said tread strips having cooperating pairs of tread strip-retaining flanges on their upper walls, (b) adjacent sets of strip-retaining flanges being spaced apart by a distance substantially less than the width of said tread strips, (c) the upper walls of said tread support elements having elongated openings formed therein in the regions between said adjacent sets of strip-retaining flanges for the passage of water and small debris.

9. Apparatus according to claim 7, further characterized by (a) said tongue and groove structures including interlocking tongue and groove configurations, whereby a pair of adjacent tread supporting elements may be assembled and disassembled only by lengthwise interfitting of one of said elements to the other.

10. Apparatus according to claim 7, further characterized by (a) said tongue and groove structures including interlocking tongue and groove configurations derived from the mechanical crimping and deformation of end portions of said tongue and groove structures.

* * * * *